US005260511A

United States Patent [19]

Gregory

[11] Patent Number: 5,260,511

[45] Date of Patent: Nov. 9, 1993

[54] MANDOLIN-SIZED STRINGED INSTRUMENT

[76] Inventor: Alex Gregory, 10863 Fruitland Dr., Studio City, Calif. 91604

[21] Appl. No.: 822,585

[22] Filed: Jan. 17, 1992

[51] Int. Cl.[5] ..... G10D 3/14; G10H 3/18

[52] U.S. Cl. ..... 84/740; 84/312 R; 84/313

[58] Field of Search ..... 84/739, 740, 742, 743, 84/268, 273, 301, 307-311, 313, 314 R, DIG. 24, 274, 312 R, 726

[56] References Cited

U.S. PATENT DOCUMENTS

| | | | |
|---|---|---|---|
| 4,171,661 | 10/1979 | Rose | 84/313 |
| 4,457,201 | 7/1984 | Storey | 84/313 |
| 4,497,236 | 2/1985 | Rose | 84/313 X |
| 4,499,809 | 2/1985 | Clevinger | 84/726 |
| 4,512,232 | 4/1985 | Schaller | 84/313 |
| 4,516,462 | 5/1985 | Schulze | 84/739 |
| 4,534,258 | 8/1985 | Anderson | 84/728 |
| 4,686,883 | 8/1987 | Piche et al. | 84/313 |
| 4,750,397 | 6/1988 | Ashworth-Jones | 84/DIG. 24 |
| 4,852,450 | 8/1989 | Novak | 84/314 R |
| 4,892,025 | 1/1989 | Steinberger | 84/313 |
| 4,919,033 | 4/1990 | Markov et al. | 84/726 |
| 4,928,564 | 5/1990 | Borisoff et al. | 84/313 |
| 4,984,493 | 1/1991 | Schaller | 84/313 |
| 5,088,375 | 2/1992 | Saijo | 84/313 |

*Primary Examiner*—Stanley J. Witkowski
*Attorney, Agent, or Firm*—Ladas & Parry

[57] ABSTRACT

A stringed instrument comprising a body and a neck, the neck having a fingerboard and a headstock and being mounted on the body and also including relatively high frets on the fingerboard. Tuning machines are mounted on the headstock and a vibrato bridge unit is mounted on the body. Strings urge the vibrato bridge unit into a quiescent, non-vibrato position. Strings are mounted between the tuning machines and the vibrato bridge unit. Strings are mounted between the tuning machines in the vibrato bridge unit, the neck having approximately a fourteen inch scale length and the strings being tuned like a violin to the notes G, D, A and E. A pick-up arrangement is mounted on the body, preferably having pole pieces which confront the strings.

16 Claims, 4 Drawing Sheets

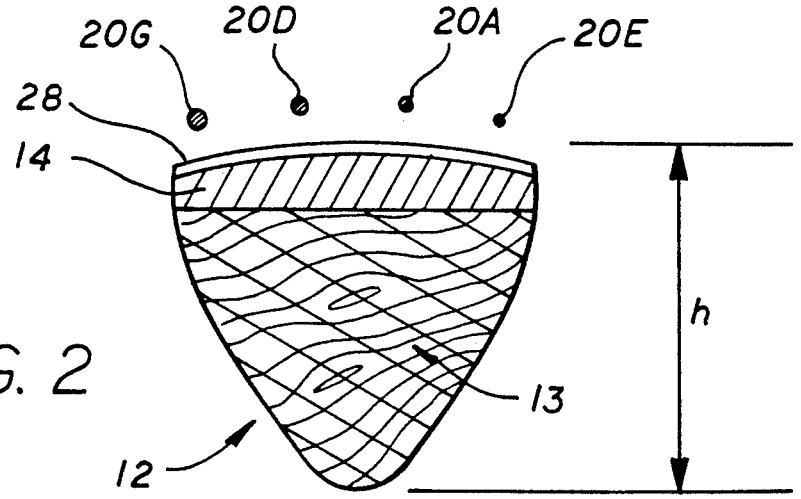
FIG. 2
FIG. 3
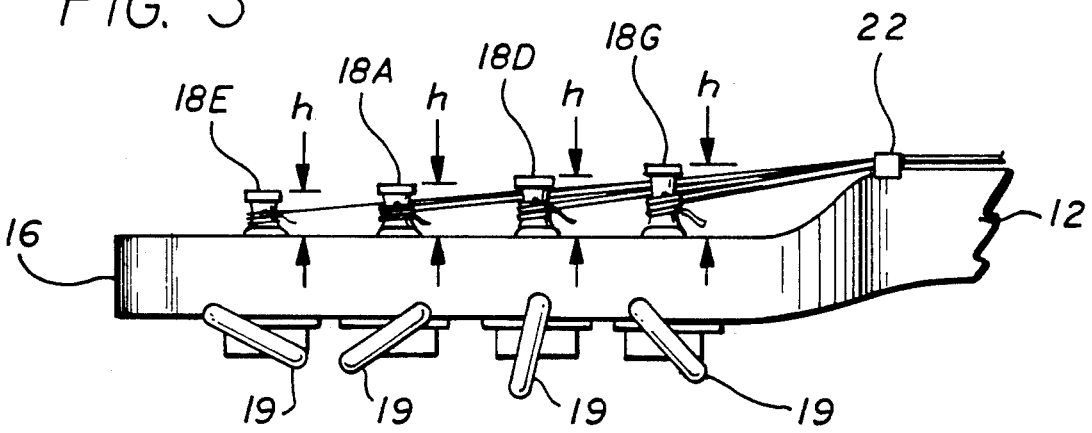
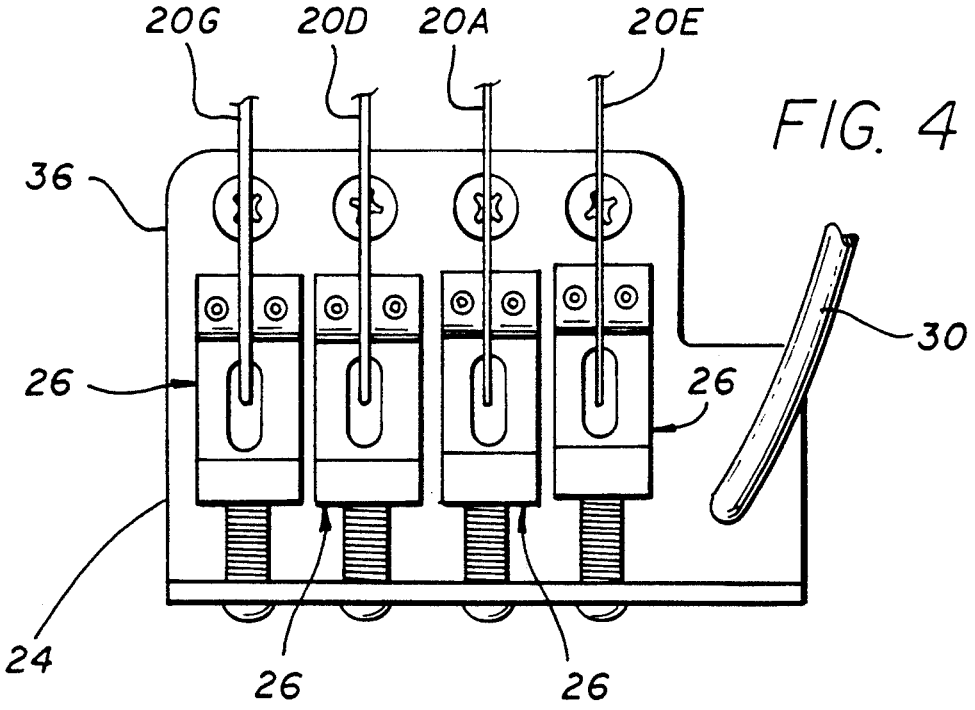
FIG. 4

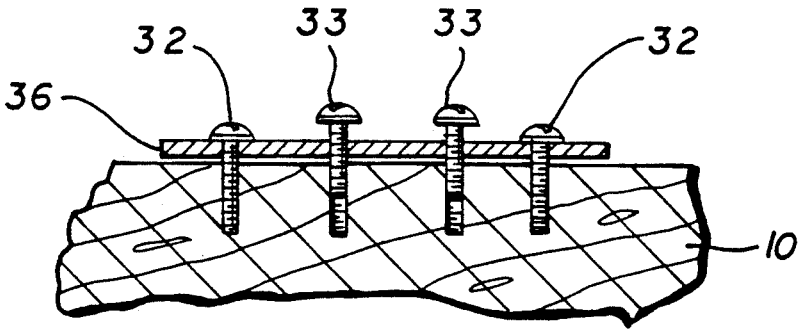
FIG. 5
FIG. 6
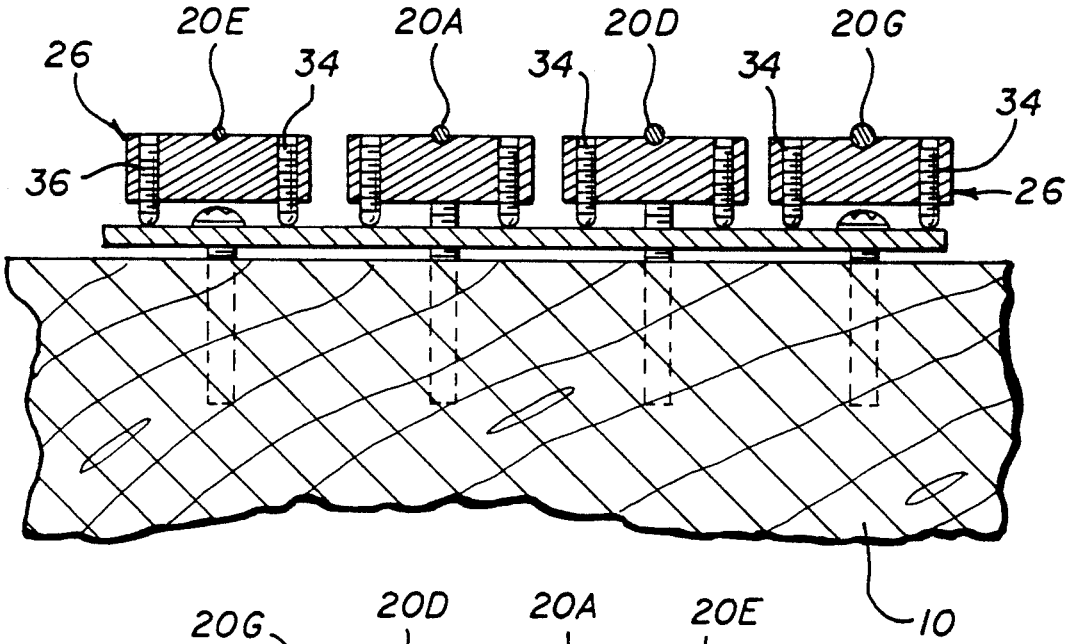
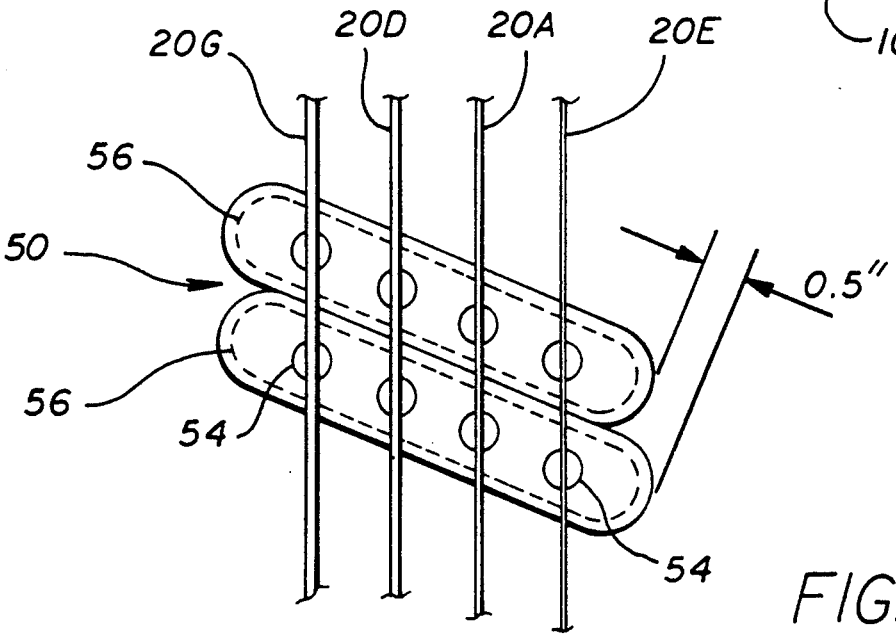
FIG. 9

MANDOLIN-SIZED STRINGED INSTRUMENT

FIELD OF THE INVENTION

The present invention relates to stringed instruments, particularly a guitar-like instrument, which has only four strings and which is close in size to a conventional mandolin.

BACKGROUND OF THE INVENTION

A conventional mandolin is part of the lute family and, indeed, it used to be called the "little lute". It came to Europe from the Orient and was already well established by the sixteenth century. Vivaldi himself wrote Concerti for mandolin and orchestra and even Paganini first played the mandolin before he took up the violin. This was probably because his father was an accomplished mandolin player. Paganini dropped the mandolin early on in favor of the violin, which was considered a more serious musical instrument. The mandolin was and is tuned exactly like the violin, but, having no bow and a flat fingerboard, the instrument had and has no sustain. In order to obtain a sustain-like sound, it was necessary for the mandolin player to continuously pluck the strings and therefore the technique used in playing the mandolin was much different than the technique used in playing the violin.

In spite of the fact that the violin was considered the more serious musical instrument, the mandolin survived, but its function and technique became more fixed and rigid with time. Gibson, in the early part of the twentieth century, tried to make the mandolin the instrument of choice over the violin and up to a point succeeded with big mandolin orchestras which were known in the 1920's. But the characteristics of the mandolin used by Gibson at that time did not change. It was the same conventional mandolin known in the prior centuries, in that it had eight strings associated in pairs and tuned, from top to bottom (position-wise), to the G.D.A and E notes.

The conventional acoustic mandolin is provided with double strings for each note to give the instrument more volume; however, each string double makes for a very slow left hand technique and, as such, is the opposite of the violin which requires a very fast left hand technique for many pieces written for the violin.

Gibson experimented with a mandolin having a $13\frac{7}{8}$ inch scale length, that is, the same scale length for the Stradivari type violin. However, this necessitated very small frets which made it even more difficult to obtain a left hand technique which would permit the fast arpeggios known in music written for the violin, for example.

The mandolin player, of course, could not try to compete with the violinist, but rather accepted the limitations of the mandolin instrument and built up a very basic technique around those limitations.

In the 1950's, Gibson introduced an electric, solid body mandolin which, apart from the fact that it was a solid body and had a pick up, it had exactly the same characteristics of the old acoustic mandolins. Fender subsequently introduced an unsuccessful electric mandolin which only had four strings, like a violin. Apparently Fender believed that since the sounds made by the instrument were being amplified anyway, there was no need for the extra four strings which had originally been used for the sake of additional volume. The Fender mandolin had the same small frets as is seen in the prior art which do not allow a fast, developed left hand technique necessary for playing fast arpeggios such as can be found in music written for the violin.

A modern electric guitar does permit a fast left hand technique, but it is tuned differently than the violin and mandolin. Still, the playing of fast arpeggios such as found in violin-type music is possible on a modern electric guitar. A suitable guitar, for that purpose, is disclosed in my prior U.S. patent application Ser. No. 636,416, filed Dec. 31, 1990 in the name of the present inventor and now U.S. Pat. No. 5,113,737, the disclosure of which is hereby incorporated by reference.

A modern studio quality guitar is, however, a rather expensive instrument. The instrument disclosed in the accompanying Application is estimated to have a retail price of only one-third to one-quarter the retail price of a modern, studio-quality electric guitar and a retail price of less than five to ten percent of a studio quality violin.

BRIEF DESCRIPTION OF THE DRAWINGS

FIG. 2 is a section view through the neck of the instrument;

FIG. 3 is a side view of the headstock portion of the neck;

FIG. 4 is a detail view of the bridge area of the instrument;

FIG. 5 is a section view through the bridge at its points of attachment to the body of the instrument;

FIG. 6 is a section view through the saddle area of the bridge;

FIG. 9 is a detail view in the pickup arrangement on the body of the instrument.

DETAILED DESCRIPTION

Figure 1:
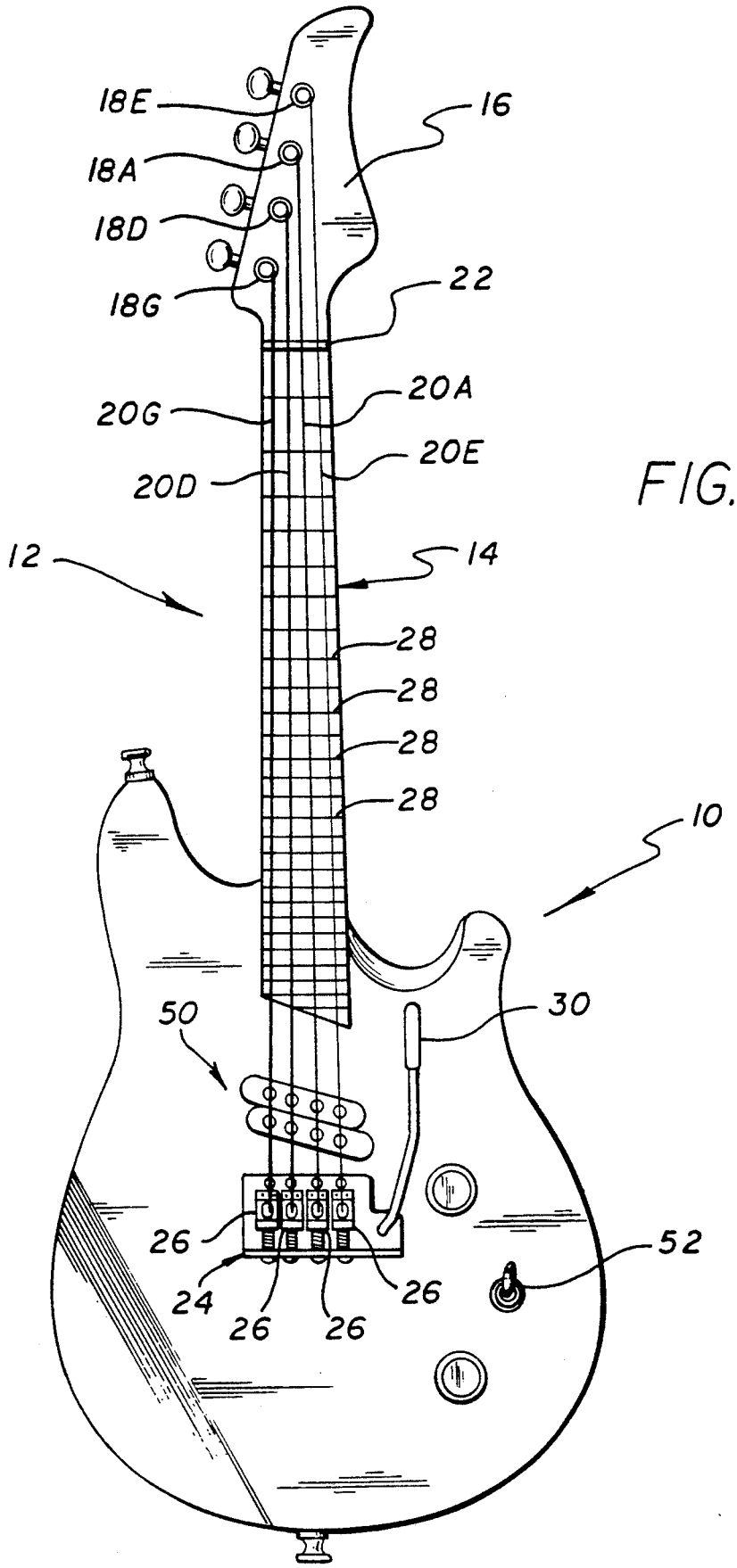
FIG. 1 is a plan view of a stringed instrument embodying the present invention.
Figure 8:
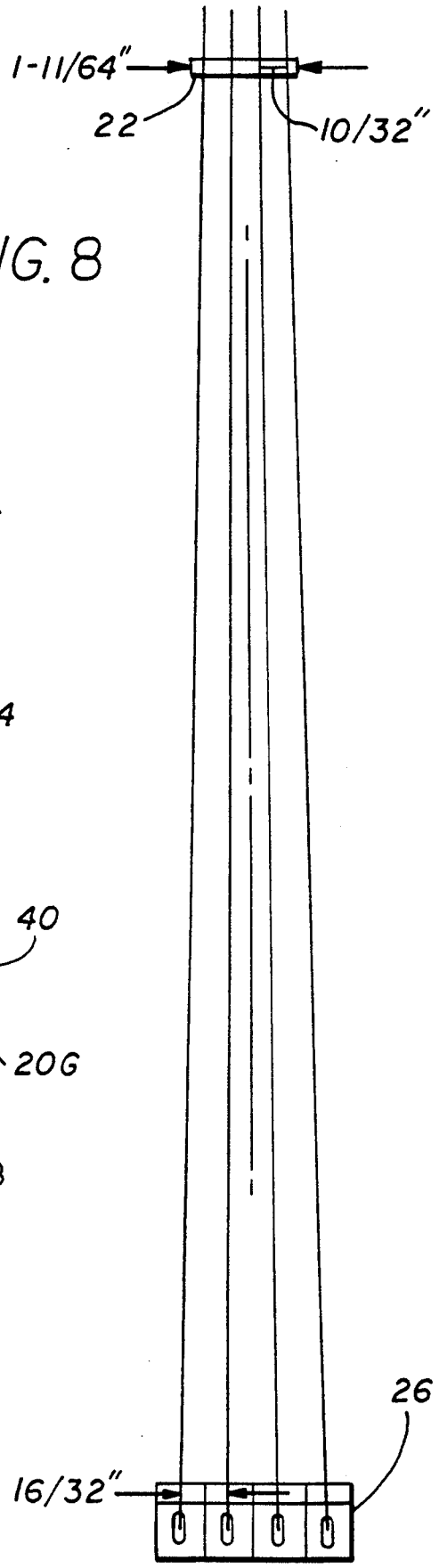
FIG. 8 shows the string spacings between the bridge and the nut.

FIG. 1 is a plan view of a stringed instrument embodying the present invention. The instrument includes a body portion 10 which would be typically made of solid wood, such as ash or maple. Attached to the body portion is a neck 12 which has a finger board portion 14 and a headstock portion 16. Mounted on the headstock are four head machines, or tuning machines 18. The letter immediately following the number "18" identifies the note value of the string associated with each head machine 18. The strings 20 are similarly identified. One end of the strings are wound around the tuning machines 18 in a conventional manner and the other ends of attached to a vibrato bridge unit 24 mounted on body 10. The vibrato bridge unit includes 24 saddles 26 against which strings 20 bear. The strings 20 also bear against a nut 22 adjacent the headstock 26 and the scale length of this instrument, as measured between the nut and the point at which the strings bear on saddles 26, is preferably 14 inches. The strings are tuned just like a violin (G D A E) and their guages are preferably 0.036, 0.024, 0.013 and 0.009 inch, respectively.

On the fingerboard 14 are mounted a number of frets 28, and, preferably the number of frets mounted on the finger board 14 are twenty-seven in number.

A section view through the neck can be seen at FIG. 2. The frets 28 are preferably formed by using 61.05 wire manufactured by Dunlap which means that the height of the frets are 0.055 inch above the adjacent outer surface of finger board 14. This size of fret is very much higher and larger that used in conventional mandolins and therefore contrary to the teachings of the prior art, but rather is the height used in guitars, for example. The fingerboard 14 which is preferably formed out of a dark wood, such as Pauferro or Ebony, is adhered to a supporting portion 13 of the neck which has a rather accentuated v-shaped configuration and the v-shaped portion 13 of the neck, in combination with finger board 14, have a height "h" of approximately 2.5 cm.

Due to the relatively short scale length of 14 inches, the overall length of the neck, including the headstock, is only on 16 the order of 16 and ¼ inches and therefore it is not necessary to use a truss rod in the neck as done in electric guitars. Since there is no need for a truss rod, the cost of manufacturing the neck 12 is much less than it is with a guitar.

FIG. 3 is a side view of the headstock 16 portion of neck 12 upon which the head machines 18 are mounted. Each head machine 18 has an associated knob 19 used to tune the string wound on the head machine. The tops of the head machine project various heights above the planer top surface of headstock 16. Indeed, tuning machine 18G preferably projects 7/16 inch above the top surface of headstock 16, while tuning machines 18D and 18A project 6/16 inch above the surface of headstock 16 while tuning machine 18E only projects 5/16 inch above that surface. Thus, the head machines are staggered in height with height with head machine 18G being the tallest and head machine 18E being the shortest.

The vibrato bridge unit 24 includes a conventional handle 30 for the purpose of modulating the frequency at which the strings vibrate in a manner known in the prior art. Details of the bridge can be seen in FIGS. 4–7. The bridge unit 24 is attached to the body 10 by preferably only two connecting screws 32 and two stabilizing screws 33 for the same reasons as taught in my U.S. Pat. No. 5,113,737, the contents of which are hereby incorporated by this reference.

The vibrato bridge unit 24 has four saddles 26 disposed thereon, which can also be seen in the section view FIG. 4 taken through those saddles. The height of each saddle is adjusted by a pair of screws 34 and the ends of screws 34 which bear against portion 36 of the bridge 24 should be ball-ended as opposed to the cup-ended screws which have been used in recent years. The use of ball-ended screws is important because cup ends then to stick against the bottom plate 36 as their edges as sharp. Ball end screws 34 do not stick because their rounded ends, and therefore the saddles 26 then to more accurately return to their original positions after handle 30 is operated.

Figure 7:
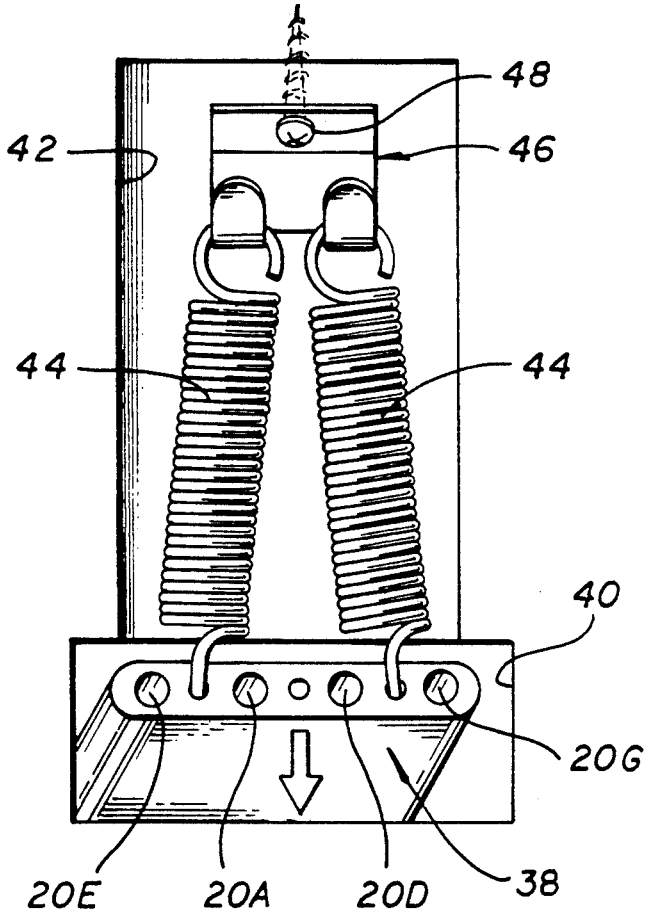
FIG. 7 is a rear view showing the attachment of the springs used to bias the bridge to the body of the guitar.

As can be seen in FIG. 7, a portion 38 of vibrato bridge unit 24 projects through an opening 40 body 10, which opening goes all the way through body 10. Those skilled in the art will appreciate that FIG. 7 is somewhat stylized in order to better depict the constructional details. Adjacent opening 40 is, on the rear side of the guitar, as can be seen in FIG. 5, a hollowed out portion 42. Portion 38 of the bridge unit 24 rocks in the direction of the arrow when lever 30 is manipulated to impart the modulation to the frequencies at which strummed strings are vibrating. Two springs 44 are attached to portion 38 at one end of the springs and to an anchor 46 at the other end of the strings, which anchor is attached by a single wood screw 48 to body 10. Wood screw extends into body 10 in a direction essentially parallel to neck 12. The use of a single wood screw 48 as a means for attaching anchor 46 to body 10 results in equal forces being imparted by springs 44 to portion 38 o the bridge unit 24. Also, the springs 44 are preferably about one third shorter then those in modern electric guitars. The single screw 48 seems to compensate for the loss of elasticity from shortening springs 44.

The saddles 26 have a centerline spacing of 16/32 inch between adjacent saddles so that the spacings of the strings 20 at the bridge unit 24 are similarly spaced. This spacing is wider than normally used in either vintage or modern electric guitars, for example. The centerline spacings of the strings 20 at nut 27 are 10/32 inch and the total width of the nut is preferably 1 and 11/64 inch. The wider saddle spacing than used in the prior art yields a wider string spacing and thereby creates an illusion of comfort and pleasure which is very important for buyers and players, which illusion would otherwise have been lost due to the short scale length and relatively large number of frets preferably employed on the instrument.

Between the bridge unit 24 and the end of the fingerboard is provided a pair of pickups 50, which are preferably wired together in a humbucking arrangement. A detailed view of the pickup arrangement can be seen in FIG. 9. A switch 52 may be provided to change whether the coils on the pickups are wired together in series or in parallel, in a manner known in the prior art. Each pickup 50 has four pole pieces 54, around which a pickup coil 56 (shown in phantom lines) is wound. The pole pieces are arranged in a straight line, but that straight line sits at an angle to the major axis of the neck, which improves the frequency range of the pickup system. The two pickups and their coils are offset a distance OS with respect to each other so that the pole pieces 54 associated with each coil 56 are essentially centered under a string 20 of the instrument. Those skilled in the art will appreciate that the two pickups 50 may be manufactured as a single unit and therefore may be referred to said a single pickup which has two coils.

Having described my invention in connection with a preferred embodiment, modification may now suggest itself to those skilled in the art. Therefore, my invention is not to be limited to the disclosed embodiment except as required by the appended claims.

What is claimed is:

1. A stringed instrument comprising:

(a) a body;

(b) a neck having a fingerboard and a headstock, said neck being mounted on said body, and including relatively high frets mounted on said fingerboard;

(c) four tuning machines mounted on said headstock;

(d) a vibrato bridge unit mounted on said body and having four saddles mounted thereon, each saddle supporting a string, a pair of springs which urge said vibrato bridge unit to a quiescent, non-vibrato position, each of said springs being attached at one end thereof to said vibrato bridge unit and being attached at the other end thereof to an anchor, said anchor being attached to said body by only one means of attachment;

(e) four strings mounted between said tuning machines and said vibrato bridge unit, said strings having approximately a fourteen inch scale length and said strings being tuned in fifths like a violin to the notes G, D, A, and E; and (f) a pickup arrangement mounted on said body, having two sets of four pole pieces, each pole piece confronting and being centered on one of said strings.

2. The stringed instrument of claim 1, wherein said sets of pole pieces are disposed adjacent to each other and wherein the pole pieces of each set are disposed in a straight line, the straight lines defined by the pole pieces of the two sets being parallel to each other and also being arranged at an angle other than 90 degrees to a major axis of said neck.

3. The stringed instrument of claim 1, wherein said tuning machines have different heights and having tops which stand at various heights above said headstock, the tuning machine associated with the G string being the longest, the tuning machine associated with the E string being the shortest and the tuning machines associated with the D and A strings having a same length between that of the longest and shortest tuning machines.

4. The stringed instrument of claim 1 wherein said saddles having a centerline spacing of 11/32 inch.

5. The stringed instrument of claim 1 wherein said saddles each have a pair of saddle height adjustment screws associated therewith, said saddle height adjustment screws having rounded, ball-type ends bearing on said bridge unit.

6. The stringed instrument of claim 1 wherein said frets have tops disposed at a height of approximately 0.055 inch above said fingerboard.

7. The stringed instrument of claim 1 tuned like a violin wherein the G string is a 0.036 gauge string, the D string is a 0.024 gauge string, the A string is a 0.013 gauge string, and the E string is a 0.009 gauge string.

8. The stringed instrument of claim 1 wherein said neck is generally V-shaped in cross section and wherein the height of neck in cross section, including the fingerboard, is approximately 2.5 cm.

9. The stringed instrument of claim 1 wherein said fingerboard has 27 frets disposed thereon.

10. The stringed instrument of claim 1, wherein said tuning machines have tops which stand at various heights above said headstock, the tuning machines associated with the G string being the longest, the tuning machine associated with the E string being the shortest, and the tuning machines associated with the D and A strings having height above said headstock between the tuning machine associated with the G string and the tuning machine associated with the E string.

11. The stringed instrument of claim 1, wherein said means of attachment for said anchor is a screw which passes through said anchor into said body.

12. A stringed instrument comprising:

(a) a body;

(b) a neck having a fingerboard and a headstock, said neck being mounted on said body, and including relatively high frets mounted on said fingerboard;

(c) four tuning machines mounted on said headstock;

(d) a vibrato bridge unit mounted on said body and having four saddles mounted thereon, each saddle supporting a string;

(e) four strings mounted between said tuning machines and said vibrato bridge unit, said strings having approximately a fourteen inch scale length and being tuned in fifths to the notes G, D, A, and E and;

(f) a pickup arrangement mounted on said body, having two sets of four pole pieces, each pole piece confronting and being centered on one of said strings.

13. The stringed instrument of claim 12 further including a pair of springs which urge said vibrato bridge unit to a quiescent, non-vibrato position, each of said springs being attached at one end thereof to said vibrato unit and being attached at the other end thereof to an anchor, said anchor being attached to said body by only one means of attachment.

14. A stringed instrument comprising:

(a) a body;

(b) a neck having a fingerboard and a headstock, said neck being mounted on said body, and including relatively high frets mounted on said fingerboard;

(c) four tuning machines mounted on said headstock;

(d) a vibrato bridge unit mounted on said body and having four saddles mounted thereon, each saddle being supporting a string;

(e) four strings mounted between said tuning machines and said vibrato bridge unit, said strings having approximately a fourteen inch scale length and being tuned in fifths to the notes G, D, A, and E; and (f) a two pickup coils mounted on said body, each pickup coil having four pole pieces, each of which confronts and is centered on one of said strings, said two pickup coils being disposed adjacent to each other and wherein the pole pieces of each pickup are disposed in a straight line, the straight lines defined by the pole pieces of the two pickup coils being parallel to each other and also being arranged at an oblique angle to a major axis of said neck.

15. A mandolin-sized instrument comprising:

(a) a body;

(b) a neck attached to said body, said neck having a finger board and a headstock, said finger board having frets mounted thereon, said frets having a height on the order of 0.055-inch above said finger board;

(c) four tuning machines mounted on said headstock;

(d) a vibrato bridge unit mounted on said body;

(e) four strings mounted between said tuning machines and said vibrato bridge unit, said strings having a fourteen inch scale length and being tuned in fifths like a violin to the notes G,D,A and E;

(f) a pick-up including at lease one pick-up coil mounted on said body, so at least one coil having four pole pieces, each of which confronts one of said strings.

16. The mandolin-sized instrument of claim 15, wherein said strings have approximately a 14 inch scale length.

* * * * *

UNITED STATES PATENT AND TRADEMARK OFFICE

CERTIFICATE OF CORRECTION

PATENT NO. : 5,260,511

DATED : November 9, 1993

INVENTOR(S) : ALEX GREGORY

It is certified that error appears in the above-indentified patent and that said Letters Patent is hereby corrected as shown below:

Column 2, line 36 Change "guitar" to --instrument--.

Column 3, line 1 Change "Dunlap" to --Dunlop--.

Column 3, line 16 Delete "16".

Column 4, line 7 Change "o" to --of--.

Claim 4, line 2 (Column 5, line 26) Change "11/32" to --16/32--

Signed and Sealed this

Second Day of August, 1994

*Attest:*

*Attesting Officer*

BRUCE LEHMAN

*Commissioner of Patents and Trademarks*